US011378348B2

(12) United States Patent
Poling

(10) Patent No.: US 11,378,348 B2
(45) Date of Patent: Jul. 5, 2022

(54) FIREARM NOISE SUPPRESSOR

(71) Applicant: Elite Iron LLC, Potomac, MT (US)

(72) Inventor: Dale Avery Poling, Potomac, MT (US)

(73) Assignee: Elite Iron LLC, Potomac, MT (US)

( * ) Notice: Subject to any disclaimer, the term of this patent is extended or adjusted under 35 U.S.C. 154(b) by 437 days.

(21) Appl. No.: 16/731,791

(22) Filed: Dec. 31, 2019

(65) Prior Publication Data

US 2020/0284541 A1 Sep. 10, 2020

Related U.S. Application Data

(60) Provisional application No. 62/786,734, filed on Dec. 31, 2018.

(51) Int. Cl.
*F41A 21/30* (2006.01)

(52) U.S. Cl.
CPC ..... *F41A 21/30* (2013.01)

(58) Field of Classification Search
CPC ..... F41A 21/30
See application file for complete search history.

(56) References Cited

U.S. PATENT DOCUMENTS

| | | | | |
|---|---|---|---|---|
| 1,066,898 | A * | 7/1913 | Gray | F41A 21/30 181/223 |
| 1,770,471 | A * | 7/1930 | Hatcher | F41A 21/30 89/14.3 |
| 3,500,955 | A * | 3/1970 | Werbell | F41A 21/30 181/223 |
| 3,667,570 | A * | 6/1972 | WerBell, III | F41A 21/30 89/14.4 |
| 3,786,895 | A | 1/1974 | Perrine | |
| 5,029,512 | A * | 7/1991 | Latka | F41A 21/30 89/14.4 |
| 8,424,635 | B1 * | 4/2013 | Klawunn | F41A 21/34 181/227 |
| 8,991,551 | B2 * | 3/2015 | Latka | F41A 21/30 89/14.4 |
| 9,316,456 | B1 | 4/2016 | Oliver | |
| 9,347,727 | B1 | 5/2016 | Cler | |
| 9,599,421 | B1 | 3/2017 | Dean | |
| 9,851,166 | B2 | 12/2017 | Petersen | |
| 10,113,826 | B2 | 10/2018 | Bray | |
| 10,222,162 | B2 * | 3/2019 | Adamson, Jr. | F41A 21/30 |
| 10,415,917 | B2 | 9/2019 | White | |
| 2018/0356173 | A1 | 12/2018 | Dorne et al. | |
| 2021/0381793 | A1 * | 12/2021 | Slack | F41A 21/34 |

* cited by examiner

*Primary Examiner* — Joshua T Semick
(74) *Attorney, Agent, or Firm* — Wood Herron & Evans LLP

(57) ABSTRACT

Provided is a firearm noise suppressor attachable to a firearm barrel. The suppressor includes a first housing attachable to a muzzle end of a firearm barrel, having a forward end first cap, and enclosing a blast chamber adjacent the muzzle end defined rearward of a barrier wall having a first axial passageway therein, a first brake chamber positioned forward of the blast chamber barrier end wall, and a first baffle module having a second axial passageway therethrough that is in axial alignment with a bore of the barrel and a plurality of longitudinally aligned separated baffle units. Each baffle unit includes a plurality of circumferentially spaced, longitudinally extending helically curved chambers with closed longitudinal ends. The helically curved chambers are in fluid communication with the second axial passageway.

6 Claims, 10 Drawing Sheets

FIREARM NOISE SUPPRESSOR

RELATED APPLICATIONS

This application claims priority to Provisional Patent Application No. 62/786,734, filed Dec. 31, 2018, and incorporates the same herein by reference.

TECHNICAL FIELD

This invention relates to a firearm noise and recoil suppressor, also colloquially called a silencer. Particularly, it relates to a baffle system for a user-configurable, modular suppressor which may be used with or without an add-on baffle/housing module.

BACKGROUND

It is known that firearm sound suppressors reduce or modify the amount of recoil and the sound level of the muzzle blast (caused by the rapid discharge of expanding propellant gases from the firearm). Typical suppressors include a generally tubular housing with an interior cavity divided into multiple chambers by a series of baffles inside the housing to redirect and delay the release of pressurized gases. Unlike other types of fluid stream mufflers, each baffle must include a passageway axially aligned with other baffles, end caps, and the bore axis of the firearm barrel to allow a projectile to pass through the suppressor without making contact.

Firearm noise suppressors reduce the sudden and loud noise of rapidly expanding propellant gases exiting the muzzle of barrel by delaying the high-pressure release of gases, consuming kinetic energy of the blast by creating internal turbulents, and by absorbing heat energy from the gas flow. Various standard baffle shapes, such as K-baffles, M-baffles, and cone baffles are well known. Likewise, monolithic suppressor cores have been made where a number of baffles and chambers are unified in a single piece of material. Modular suppressors have been made that allow the user to choose the number of baffles to be used for a given situation. A shorter suppressor with fewer baffles weighs less and adds less length to the muzzle of the firearm, while giving up some degree of sound suppression performance. Longer suppressors with more baffles provide superior sound and recoil suppression performance but add weight and length to the firearm. With a standard suppressor, the user must choose which of these alternatives better suits the situation. A modular suppressor provides the user with both options in a single device.

SUMMARY OF THE INVENTION

The present invention provides a modular firearm suppressor which can be used in a shorter, single-stage configuration or in a longer, two-stage configuration.

The first stage includes a blast module and a first baffle module with a brake chamber between them. The blast module can have an annular blast chamber around a ported passageway that receives the muzzle or a muzzle attachment device. The first baffle module includes a ported central passageway with a series of radial, helical chambers. The second stage cannot be used separately, but is detachably secured to the first stage, and includes a second baffle module that has a ported central passageway with a series of radial, helical chambers.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
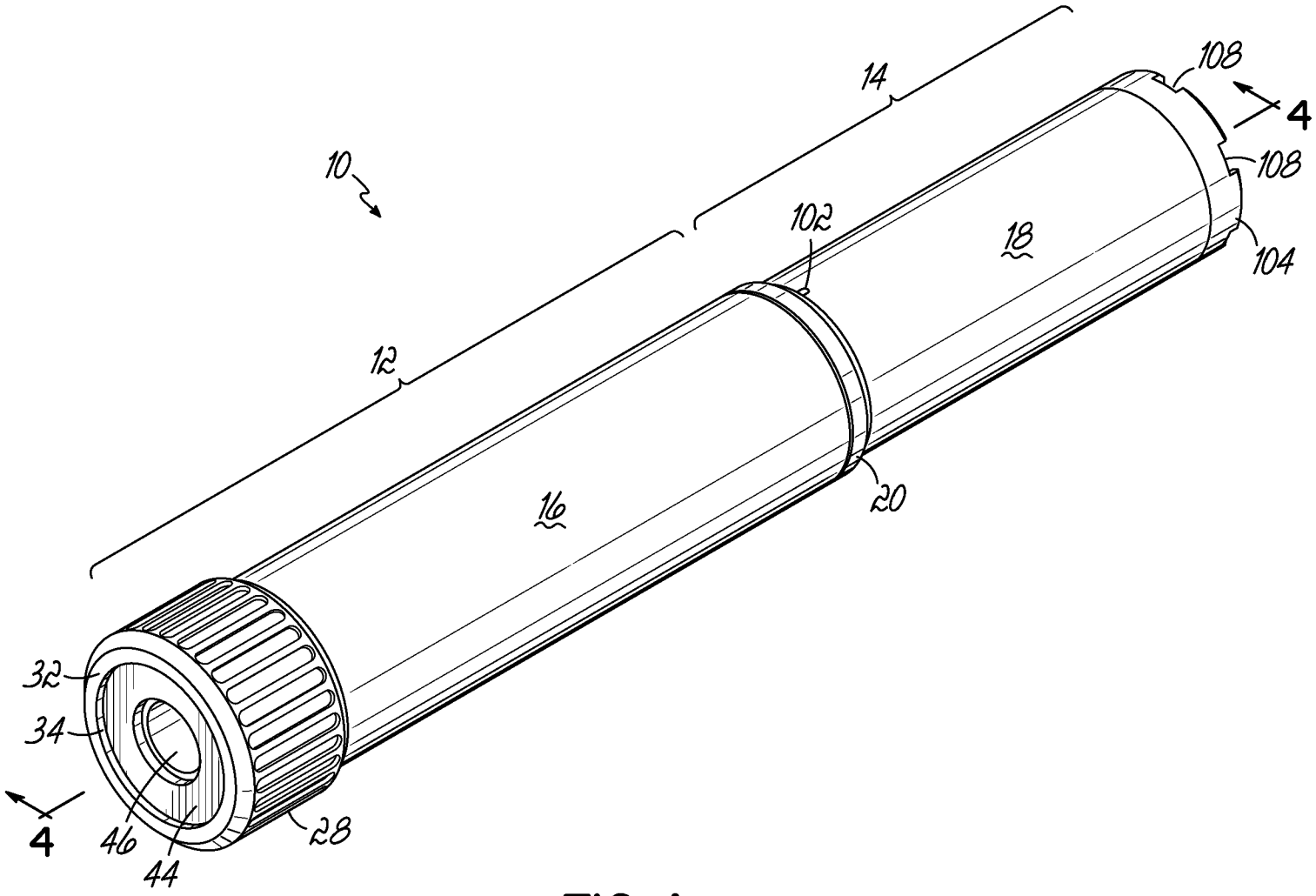
FIG. 1 is a rear isometric view of a two-stage firearm suppressor according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
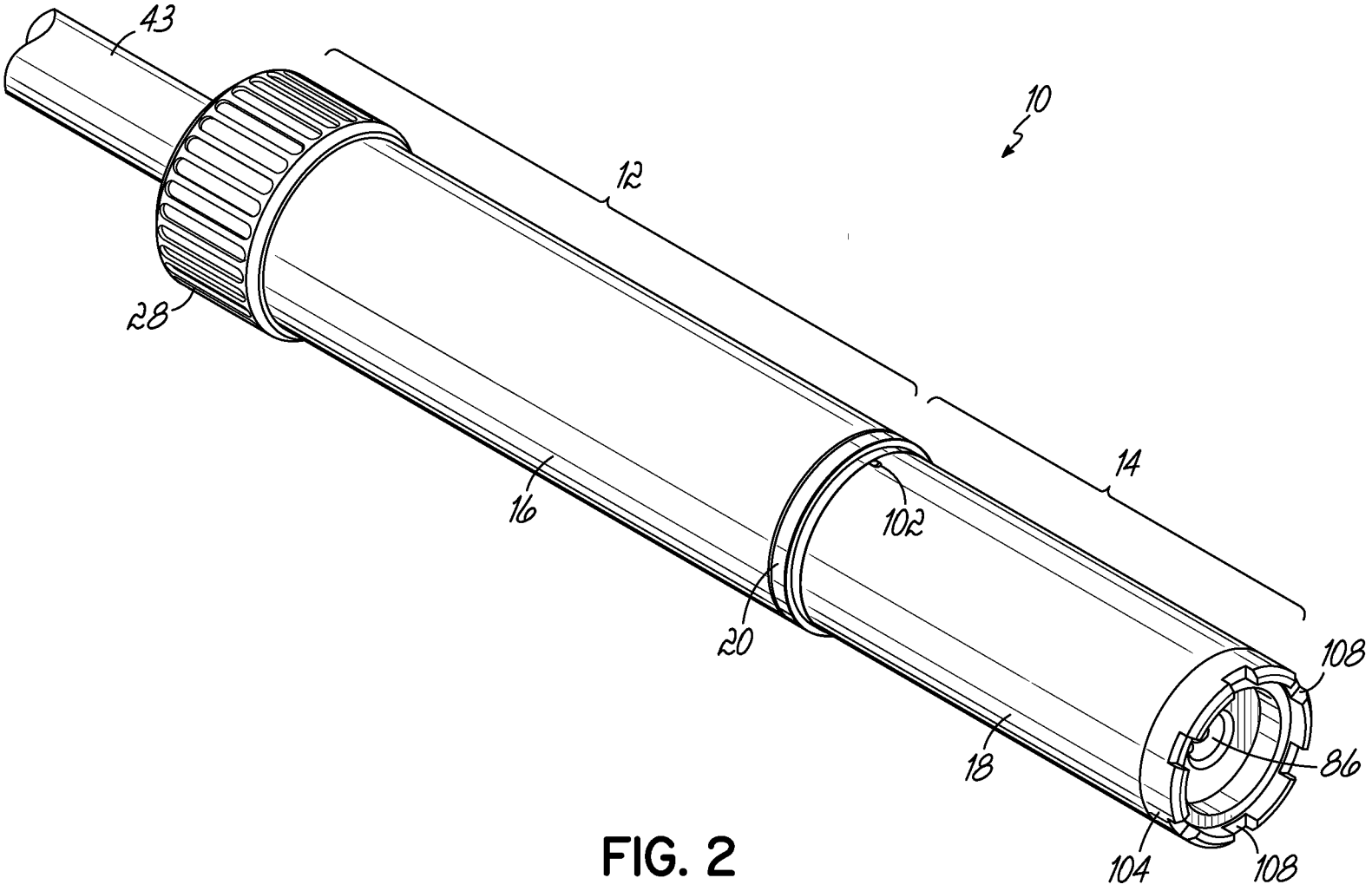
FIG. 2 is a front isometric view thereof.
Figure 3:
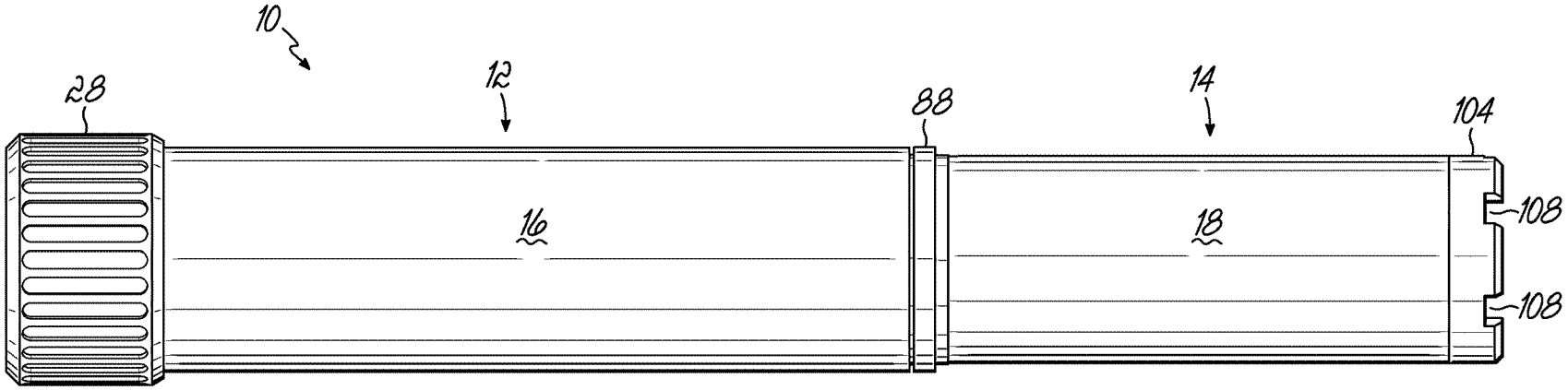
FIG. 3 is a side elevation view thereof.
Figure 4:
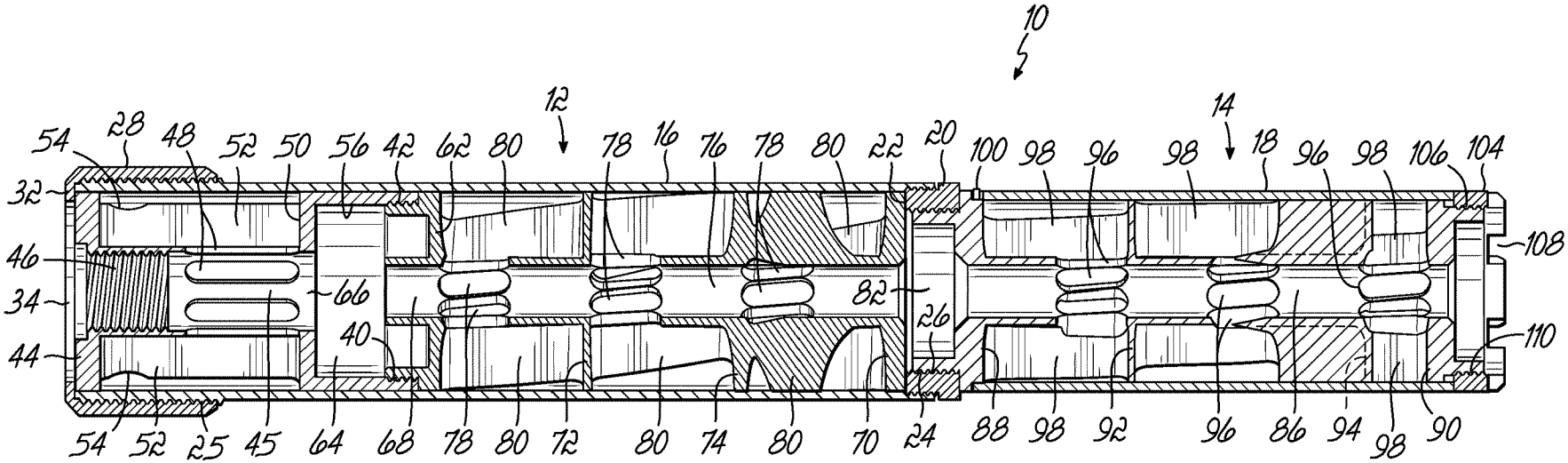
FIG. 4 is a side sectional view taken substantially along line 4-4 of FIG. 1.

Referring first to FIGS. 1-3, therein is shown a modular firearm noise suppressor 10 according to one embodiment of the present invention. This suppressor 10 has two separable modules or stages: a first stage 12 that attaches to the barrel of a firearm (not shown), and a second stage 14 that is removably attached to the first stage 12. The first stage 12 can be used independent of the second stage 14. However, the second stage 14 cannot be used independent of the first stage 12. Each of the stages 12, 14 include a substantially cylindrical housing tube 16, 18. In the illustrated embodiment, the housing tube 18 for the second stage 14 has a smaller diameter than that of the housing tube 16 for the first stage 12.

Referring now also to FIGS. 4, 5, 10, and 11, the housing tube 16 of the first stage 12 includes an annular insert 20 that provides a reduced diameter shoulder portion that provides an interior annular rim 22 and includes interior connection threads 24. The annular rim 22 could be provided by a shoulder integral with the housing tube 16, or the insert 20 may be permanently joined to the housing tube 16, such as by adhesive or welding. An exterior surface at the rear of the housing tube is also threaded 25. A collar 28 has interior threads 30 that mate with the exterior threads 25 at the rear of the housing tube 12. The collar 28 includes a reduced diameter lip 32 defining a rear opening 34. Optionally, the exterior surface of the collar 28 may include knurling or other grip-enhancing texture or feature, as shown.

Figure 5:
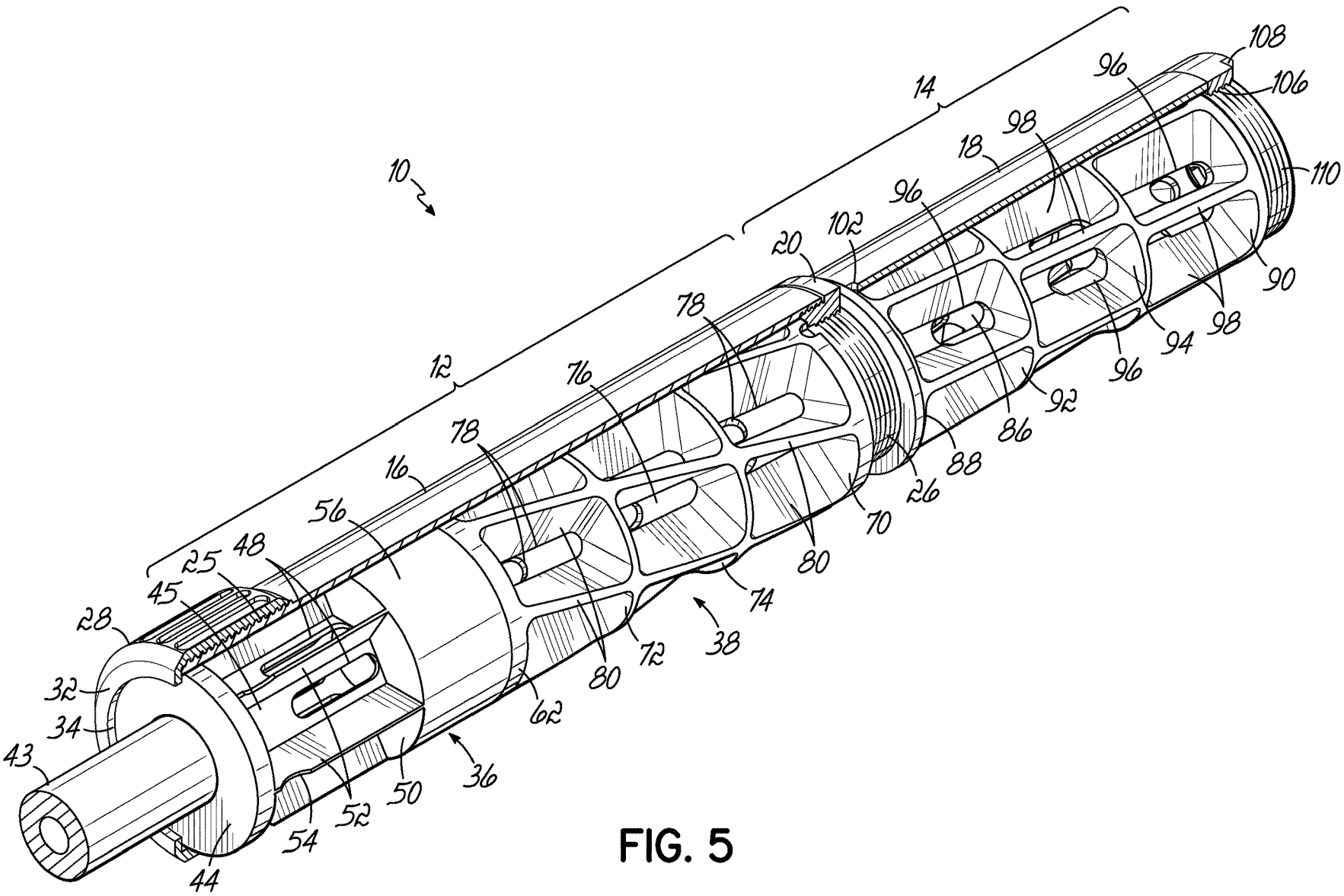
FIG. 5 is an isometric, partially cut-away view thereof.
Figure 7:
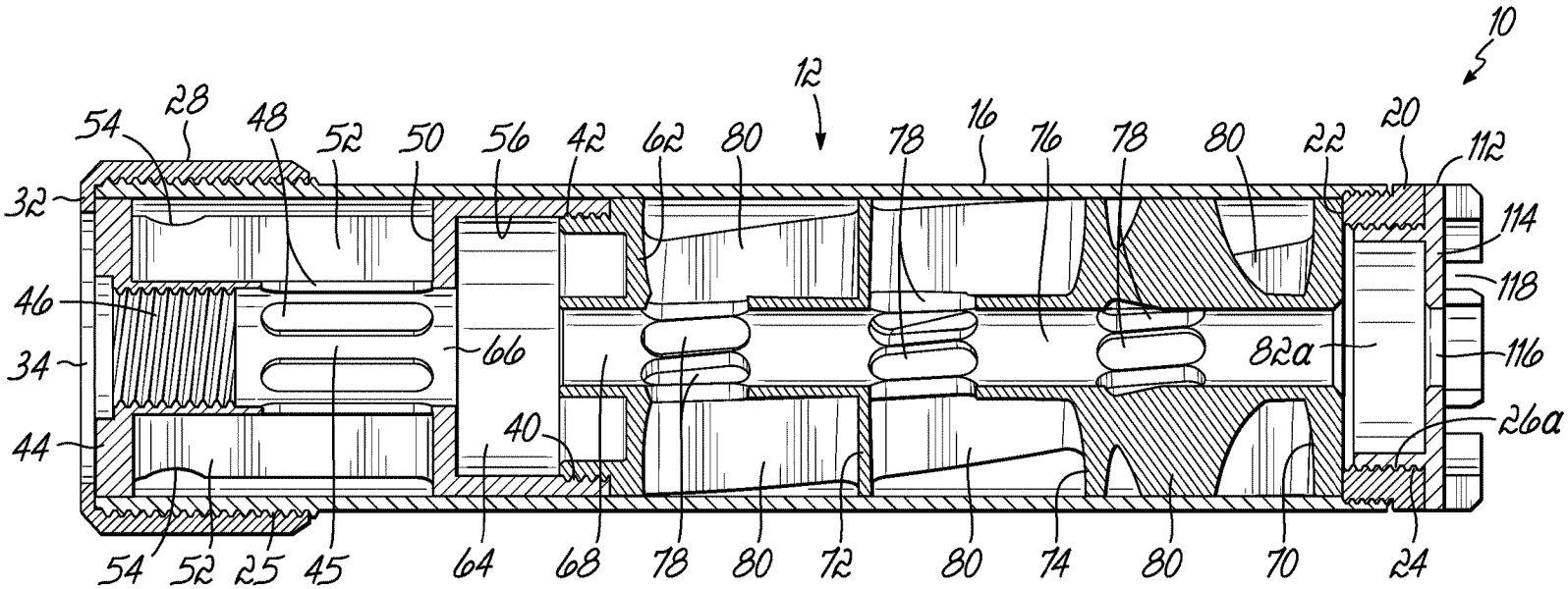
FIG. 7 is a side sectional view thereof taken substantially along line 7-7 of FIG. 8.
Figure 8:
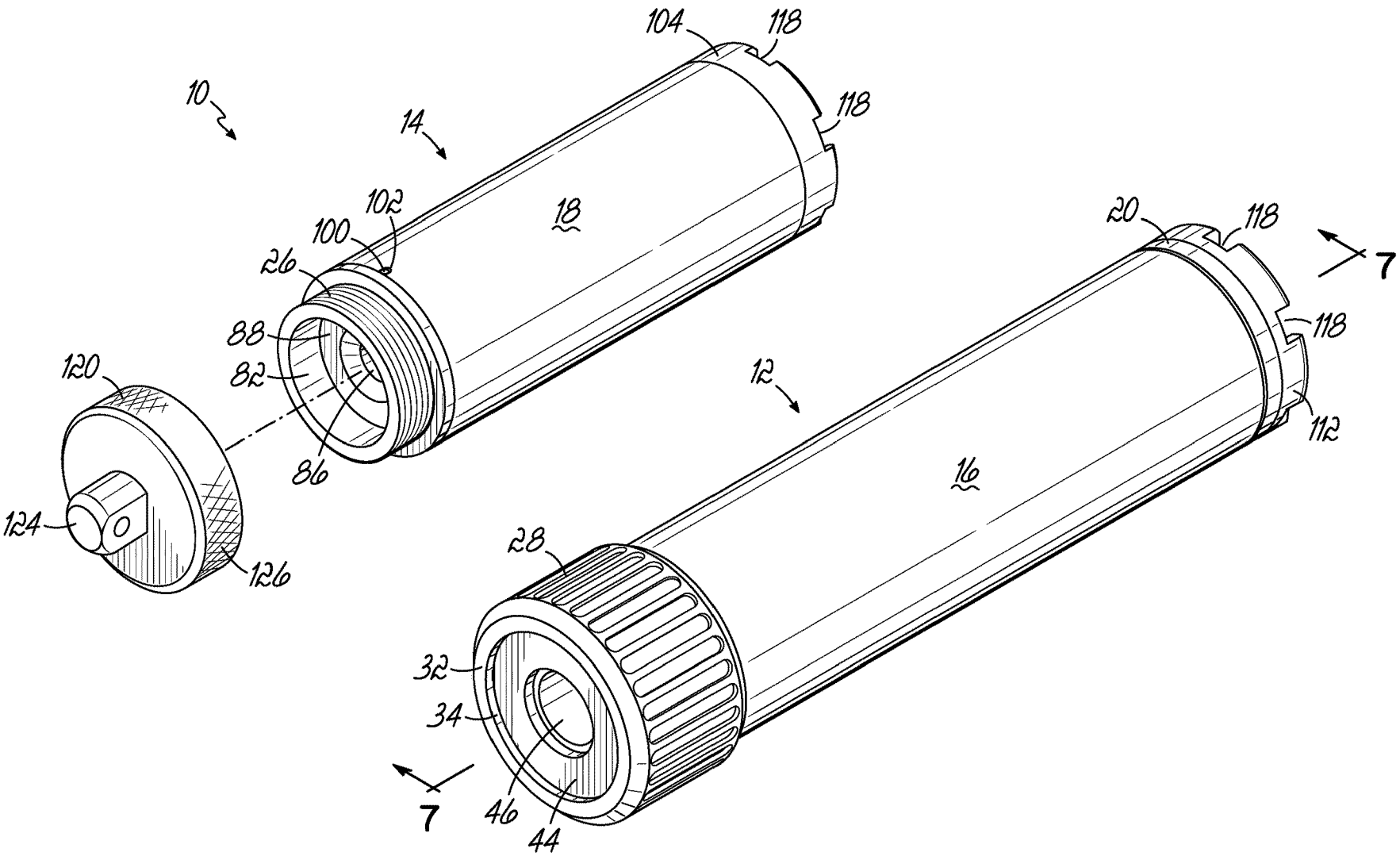
FIG. 8 is a rear isometric view of the separated stages of a modular firearm suppressor according to an embodiment of the present invention.
Figure 9:
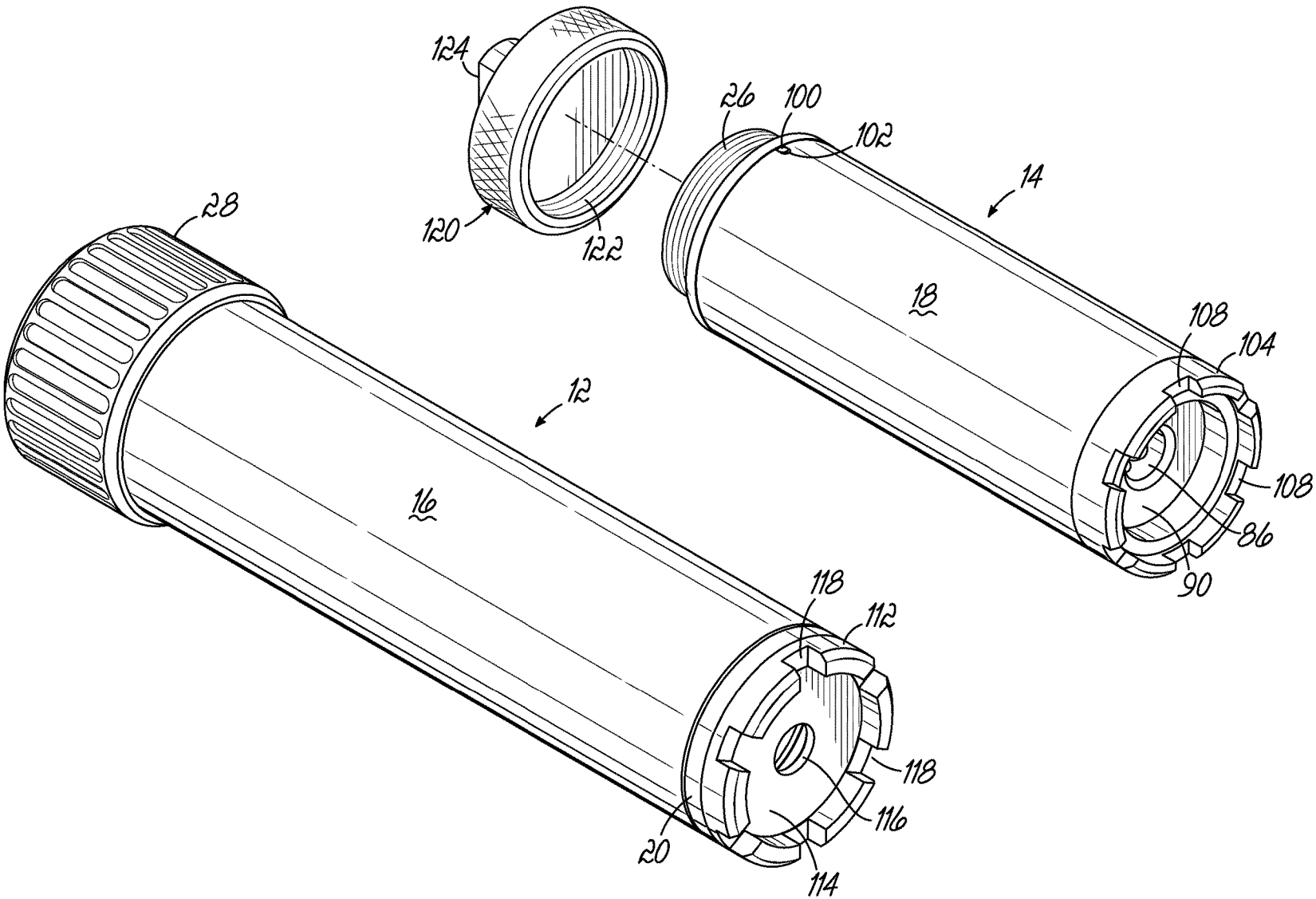
FIG. 9 is a front isometric view thereof.

As shown in FIGS. 5 and 7, inside the first stage housing tube 16 are a blast module 36 and a first baffle module 38. The blast module 36 and first baffle module 38 may be coupled together, such as by threads 40, 42. Both the blast module 36 and first baffle module 38 have an exterior diameter sized to closely fit within the interior of the first stage housing tube 16. Both include an axial bore that will be aligned with the bore axis of a firearm barrel 43 to which the suppressor 10 is attached and which is sized to allow a projectile of a selected diameter to pass without contact.

The blast module 36 includes a rear end wall 44 and is configured for attachment to the muzzle end of a firearm barrel 43. In the illustrated embodiment, threads 46 are provided that can directly attach to exterior threads at the muzzle of a barrel 43. Alternatively, the suppressor 10 may be configured with lugs or acme threads to engage an adapter or muzzle device (not shown), such as a flash hider or muzzle brake. Such a muzzle device could extend into the blast module 36 and be configured to contribute to diverting the flow of expanding propellant gases radially into the blast module 36. Extending forward from the rear end wall 44 is a tubular portion 45 having a plurality of elongated and circumferentially spaced ports 48 forward of the threaded portion 46. Outward of this tubular portion 45, between a forward wall 50 and the rear end wall 44 is an annular space that may be divided into chambers by a plurality of longitudinal, radial vanes 52. In the illustrated embodiment, cutouts 54 in the vanes 52 allow cross flow of pressurized gas between the chambers defined between the vanes 52. These collectively provide a blast chamber with forward wall 50 acting as a blast wall or baffle against which propellant gases of the highest temperature, highest velocity, and highest pressure will impact. For these reasons, and because the blast module 36 supports the suppressor 10 on the firearm barrel, the blast module 36 should be made from a durable material resistant to erosion and not degraded by high temperatures. Alternatively, the blast module vanes 52 may have radially inward edges that define the axial passageway through which a projectile passes, eliminating the tubular portion 45 and its ports 48.

Extending forward from the forward wall 50 of the blast module 36 is a cylindrical wall 56 that may include internal threads 40 at its forward end. As previously described, threads 42 at its rearward end of the first baffle module 38 can be used to connect the blast module 36 and first baffle module 38. A key 58 may be provided on the shoulder portion 20 or annular rim that engages a corresponding notch 60 on the first baffle module 38 (or vice versa). This engagement prevents the first baffle module 38 from rotating inside the first stage housing tube 16. In turn, the threaded engagement 40, 42 between the first baffle module 38 and blast module 36 prevent the blast module 36 from rotating inside the tube 16. Because the blast module 36 carries the means for connecting the suppressor 10 to the firearm barrel (such as direct threads 46) in this embodiment, it is important that the blast module 36 not rotate inside the housing tube 16 so that the suppressor 10 may be turned as a unit for attachment to the firearm barrel by gripping the housing tube 16. The collar 28 keeps the blast module 36 and first baffle module 38 captured within the tubular housing 12 and against the annular rim 22, while allowing ease of disassembly for maintenance.

A brake chamber 64 is defined between a rear end wall 62 of the first baffle module 38 and the forward wall 50 and cylindrical wall 56 of the blast module 36. The brake chamber 64 allows high pressure propellant gas flowing through an aperture 66 in the forward wall 50 to expand and stabilize before venting into the next chambers of the first baffle module 38. This pressure stabilization can be important for reducing back pressure against the operating system of a gas operated firearm action and to prevent cross-flow too close to the projectile that may affect its flight stability. A truncated tubular passageway 68 may extend rearwardly from the rear end wall 62 of the first baffle module 38 to induce turbulence into the flow of propellant gas behind the projectile and to retard the venting of gas into the next chamber.

The first baffle module 38 has three chamber areas defined between the rear end wall 62 and a forward end wall 70, and separated by two intermediate walls 72, 74. A tubular passageway 76 is axially aligned with the bore of the barrel 43 and allows passage of a fired projectile without contact. The tubular passageway 76 has circumferentially spaced ports 78 that vent propellant gas radially into the annular spaces between the rear end wall 60, forward wall 70, intermediate walls 72, 74, and the housing tube 16. The three annular spaces are divided into elongated chambers by elongated baffle vanes 80. In the illustrated embodiment, six circumferentially spaced vanes 80 in each space define six chambers in each space. The ports 78 may be positioned toward the rear of each chamber so the forwardly flowing gas stream can freely enter. Between each set of ports 78, the tubular passageway 76 may be uninterrupted, so as to maintain projectile flight stability.

According to the illustrated embodiment, the ports 78 and the vanes 80 are configured helically and in the direction of the projectile's spin (right hand twist). If desired, the vanes 80 and chambers between them could be axially oriented or could helix in the direction opposite the spin of the projectile. However, the helical configuration allows the flow path of each chamber to be longer and increases the heat-adsorbing surface area of the vanes 80.

At the forward end of the first baffle module 38, where the second stage 14 attaches to the first stage 12, there is a second brake chamber 82. This chamber 82 again allows the propellant gas flowing through tubular passageway 76 to expand and stabilize before venting into the second baffle module 84. The volume of the second brake chamber 82 can be smaller than that of the first brake chamber 64.

As shown in FIGS. 4, 5, 10, and 11, the operative structure of the second baffle module 84 is similar to that of the first baffle module 38. However, if the diameter of the second stage housing tube 18 is smaller than that of the first stage housing tube 16 (as shown), the volume of each chamber is smaller. The pressure of the propellant gas will have been significantly reduced in the first stage 12 and, while the second stage 14 significantly further reduces the report and recoil, it can do so effectively with smaller chambers. The second baffle module 84 includes a tubular passageway 86 axially aligned with the first tubular passageway 76 and bore of the barrel 43. Again, the second baffle module 84 has three chamber areas defined between a rear end wall 88 and a forward end wall 90, and separated by two intermediate walls 92, 94. The tubular passageway 86 has circumferentially spaced ports 96 that vent propellant gas radially into the annular spaces between the rear end wall 88, forward wall 90, intermediate walls 92, 94, and the housing tube 18. The three annular spaces are divided into elongated chambers by elongated baffle vanes 98. In the illustrated embodiment, six circumferentially spaced vanes 98 in each space define six chambers in each space. The ports 96 may be positioned toward the rear of each chamber so the forwardly flowing gas stream can freely enter. Between each set of ports 96, the tubular passageway 86 may be uninterrupted, so as to maintain projectile flight stability.

Again, according to the illustrated embodiment, the ports 96 and the vanes 98 are configured helically and in the direction of the projectile's spin (right hand twist). If desired, the vanes 98 and chambers between them could be axially oriented or could helix in the direction opposite the spin of the projectile. However, the helical configuration allows the flow path of each chamber to be longer and increases the heat-adsorbing surface area of the vanes 98.

As previously described, the second stage 14 is attached to the first stage 12 by the threaded connection 24, 26. The second baffle module 84 may be keyed to the second tubular housing 18, for example, by an alignment pin 100 that fits into a notch 102 in the rear edge of the tube 18 to prevent relative rotation between them. The rotational orientation of the baffle module 84 is not critical to its performance, but the tube 18 provides a gripping surface by which the second stage 14 is turned to thread it onto or off of the first stage 14. Finally, a second stage nose piece 104 is threaded onto the forward end of the second baffle module 84 to secure the tubular housing 18 in place. The nose piece 104 may be in the form of an internally threaded (at 106) castle nut with notches that can be engaged by a tool for rotation. In the illustrated embodiment, the notches 108 are relatively large and are transversely aligned so that a nonspecific, field-expedient tool (such as a screwdriver, multitool, knife, or bayonet) may be used. If desired, the nose piece 104 could include a transverse wall (not shown) with a central opening that would create another brake chamber forward of the second baffle module 84. If the nose piece 104 is fixed permanently or semi-permanently to the second baffle module 84, the notches 108 can be used to loosen the second stage 14 from the first stage 12.

Other than the key notch 102, the second tubular housing may be a simple tube with no internal or external threads. This minimizes cost of manufacture and prevents use of the part, separate from the combination, as a part of another suppressor assembly. When the nose piece 104 is threaded in place on forward threads 110 of the second baffle module 84, the second stage 14 may be handled as a unit without any lose parts.

The blast module 36 and both baffle modules 38, 84 each may be made as a monolithic unit, such as by machining from a single piece of material, "printing" by additive manufacturing methods and materials, casting, or molding.

In the two-stage configuration (illustrated in FIGS. 1-5), the suppressor 10 has maximum noise, flash, and recoil suppression performance, but at a premium of additional length and weight. For shots where the shooter is at a fixed location and/or can rest the rifle on a support or bipod, this configuration is ideal. When the shooter is moving or operating in close quarters, a shorter and lighter configuration—with some sacrifice to performance—may be preferred. In the latter situation, the modular suppressor 10 may be used in its single stage configuration (shown in FIGS. 6 and 7).

Figure 6:
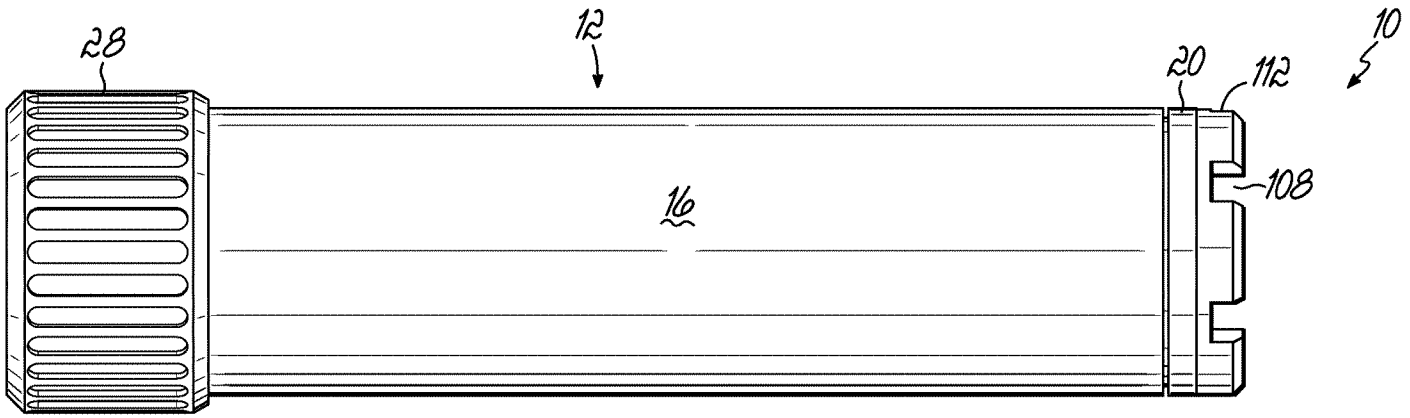
FIG. 6 is a side elevation view of a single-stage firearm suppressor according to an embodiment of the present invention.

Referring now in particular to FIGS. 5, 6, and 7, in the single stage configuration, the first stage 12 of the suppressor 10 can be used alone, providing hearing-safe sound suppression in a shorter, lighter system. When the second stage 14 is removed (by unthreading the connection 24, 26, a first stage nose piece 112 is attached in its place. The first stage nose piece 112 has threads 26*a* that match those 26 of the second stage baffle module 84 and it has a forward wall 114 that defines an alternate second brake chamber 82*a* forward of the front end wall 70 of the first baffle module 38. The forward wall 114 includes an outlet passageway 116 sized and positioned to allow the projectile to pass without contact. The nose piece 112 may also include tool notches 118 similar in design and function to the notches 108 of the second stage nose piece 104. The nose piece 112 could be adapted to include a secondary flash hider or glass breaking point (not shown).

Referring now to FIGS. 8-13, a thread protector/retainer cap 120 may be provided. The cap 120 is threaded (at 122) to engage the threads 26 of the second stage 14 and the threads 26*a* of the first stage nose piece 112. Because the second stage 14 may be carried in a pouch, pocket, or pack when separated from the first stage 12, use of the retainer cap 120 will protect the otherwise exposed attachment threads 26. Because the threads 26*a* of the first stage nose piece 114 are the same as those 26 on the second stage 14, the nose piece and the retainer cap 120 can likewise be coupled.

The retainer cap 120 may include external knurling 126 or flats to enhance grip. If desired, a lanyard attachment 124 on the retainer cap 120 allows it to be secured to a pack or vest. The first stage nose piece 104 and the second stage 14 cannot be in use at the same time. So, a lanyard attachment prevents loss and provides easy retrieval not only of the cap 120, but also of the second stage 14 and nose piece 114 when stowed in a pack, pouch, or pocket. The lanyard attachment 124 may be a simple loop or through-hole that allows a cord or hook to be secured. Or, the attachment 124 may be in the form of a sling swivel stud (as generally shown), quick-detach single-point sling socket/stud, or any other suitable attachment device or means.

In some jurisdiction, such as the United States under current law, it is important that a modular suppressor not have parts that are separately attachable to a firearm. In this regard, the second stage 14 of the illustrated embodiment cannot be used separately from the first stage 12 and the parts cannot be interchanged or reconfigured, other than as one single-stage or one multi-stage suppressor.

Figure 10:
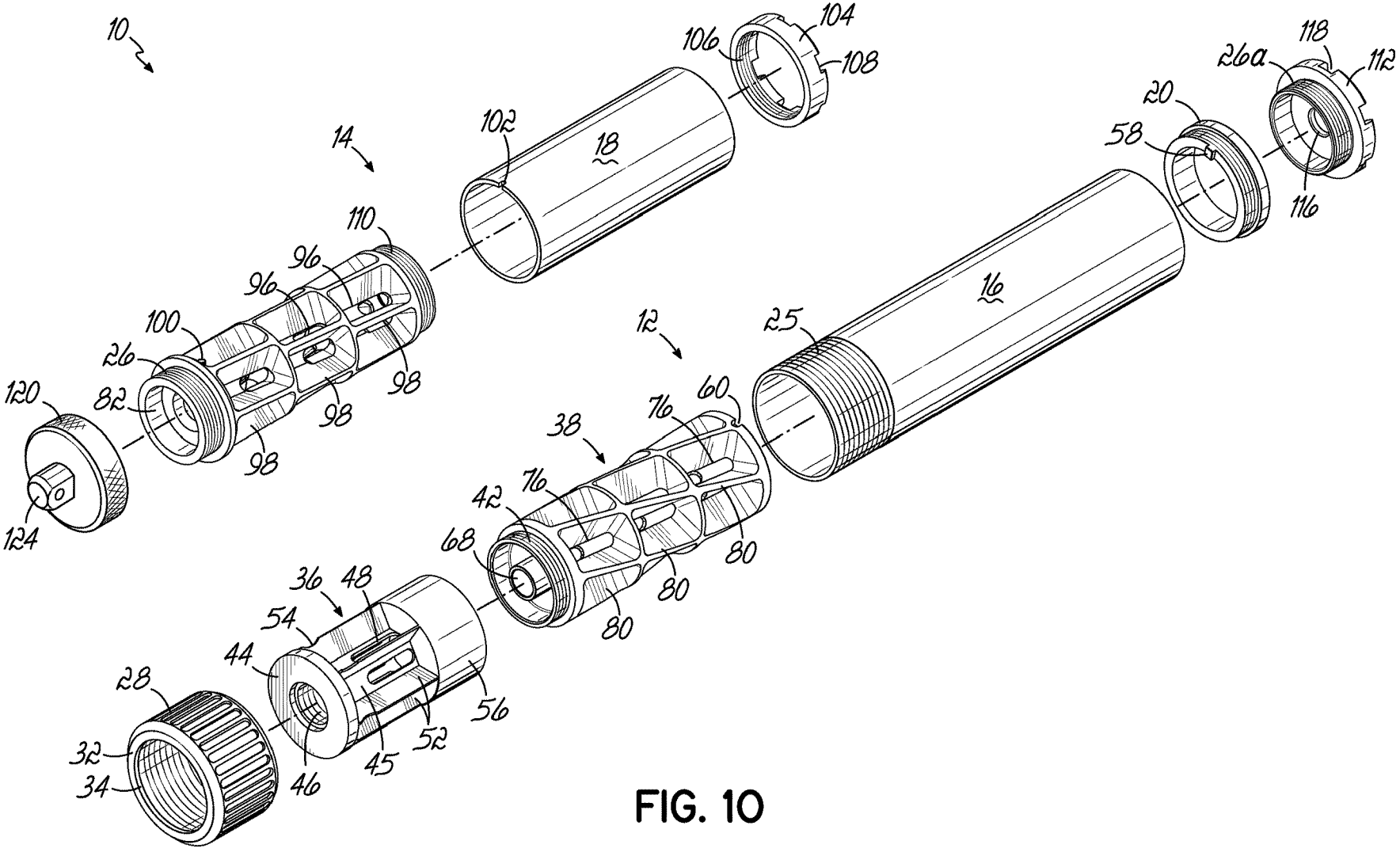
FIG. 10 is a rear isometric exploded view thereof.
Figure 11:
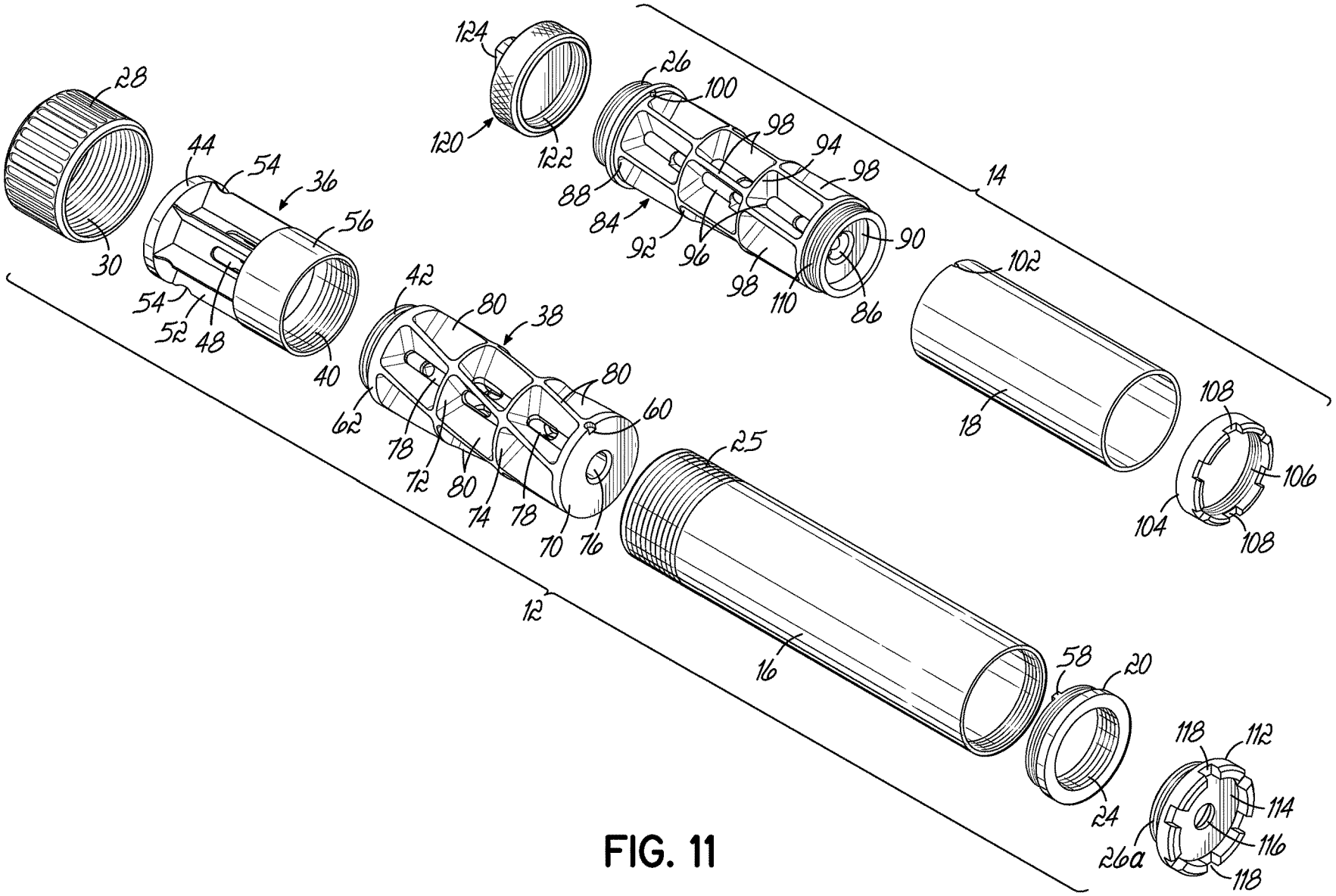
FIG. 11 is a forward isometric exploded view thereof.
Figure 13:
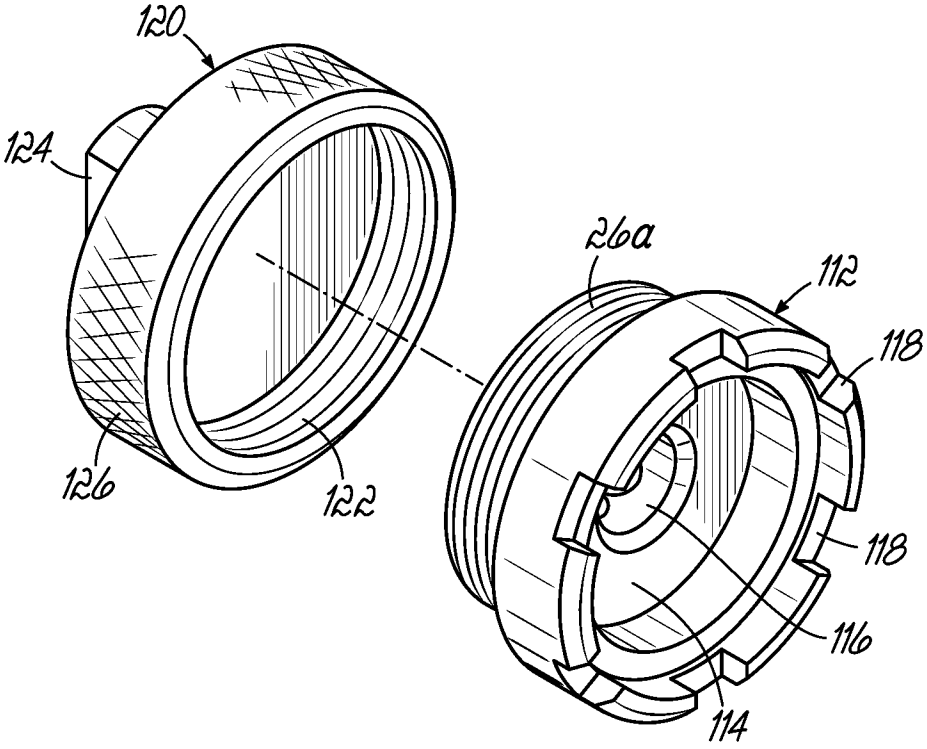
FIG. 13 is an opposite isometric view thereof showing the thread-protector/retainer cap and first stage nose cap separated.
Figure 12:
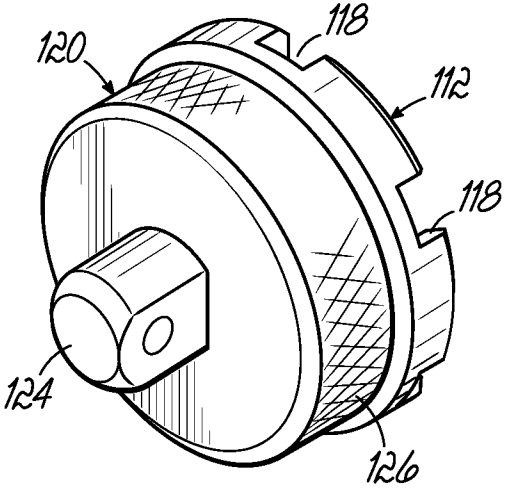
FIG. 12 is a first isometric view showing a thread-protector/retainer cap connected to the first stage nose cap.

Referring now also to FIGS. 10 and 11, the illustrated suppressor 10 may be completely disassembled for internal cleaning or servicing. Typically, modern centerfire ammunition is clean enough that routine internal cleaning is unnecessary. Threaded connections 25, 30, 40, 42, 106, 110 within each stage 12, 14 may be sealed with a heat-resistant thread-locking or thread-sealing adhesive compound (such as Loctite™ or Rockset™) so that any servicing other than configuring the suppressor in one or two stages is not done in the field and is done only by an armorer, a gunsmith, or the manufacturer.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm noise suppressor attachable to a firearm barrel having an axial bore and a muzzle end, the suppressor comprising:

a first housing attachable to a muzzle end of a firearm barrel, having a forward end first cap, and enclosing:

a blast chamber adjacent the muzzle end defined rearward of a barrier wall having a first axial passageway therein;

first brake chamber positioned forward of barrier wall; and a first baffle module having a second axial passageway therethrough that is in axial alignment with a bore of the barrel and a plurality of longitudinally aligned separated baffle units, each baffle unit including a plurality of circumferentially spaced, longitudinally extending helically curved chambers defined by radial dividing walls with closed longitudinal ends, the helically curved chambers being in fluid communication with the second axial passageway.

2. The suppressor of claim 1, wherein the first housing and first cap are threaded to provide a separable threaded connection therebetween.

3. The suppressor of claim 2, further comprising a second stage threaded for attachment to the first housing in place of the first cap, the second stage comprising:

a second housing having a forward end cap and enclosing a second baffle module, the second baffle module including a third axial passageway therethrough that is in axial alignment with the second axial passageway and a second plurality of longitudinally aligned separated baffle units, each baffle unit including a plurality of circumferentially spaced, longitudinally extending helically curved chambers with closed longitudinal ends, the helically curved chambers being in fluid communication with the third axial passageway.

4. The suppressor of claim 3, further comprising a second brake chamber between the first and second baffle modules when the second stage is attached to the first housing.

5. The suppressor of claim 1, further comprising a second brake chamber between the first baffle module and the first cap.

6. The suppressor of claim 1, wherein the blast chamber includes longitudinal vanes extending radially to divide spaces between the first axial passageway and the first housing into circumferentially spaced compartments.

* * * * *